United States Patent [19]

Holmgren

[11] Patent Number: 4,489,957

[45] Date of Patent: Dec. 25, 1984

[54] TOOL FOR SAILING WITH SKATES ETC.

[76] Inventor: Klas Holmgren, Tulegatan 45$^{III}$, 113 53 Stockholm Sverige, Sweden

[21] Appl. No.: 375,032

[22] PCT Filed: Nov. 7, 1980

[86] PCT No.: PCT/SE80/00281

§ 371 Date: Apr. 19, 1982

§ 102(e) Date: Apr. 19, 1982

[87] PCT Pub. No.: WO82/00593

PCT Pub. Date: Mar. 4, 1982

[30] Foreign Application Priority Data

Aug. 19, 1980 [SE] Sweden ..... 8005834

[51] Int. Cl.$^3$ ..... A63C 3/00

[52] U.S. Cl. ..... 280/810; 114/39; 114/43

[58] Field of Search ..... 280/809, 810, 213, 87.04 A, 280/818; 114/39, 103, 43, 108; 180/181, 180, 2.2

[56] References Cited

U.S. PATENT DOCUMENTS

| | | | |
|---|---|---|---|
| 2,213,754 | 9/1940 | Thirring | 280/810 |
| 3,349,741 | 10/1967 | Herbst | 114/43 |
| 3,487,800 | 1/1970 | Schweitzer | 114/91 |
| 3,996,873 | 12/1976 | Weghorn | 114/108 |
| 4,037,553 | 7/1977 | Marker | 114/39 |
| 4,311,324 | 1/1982 | Fries | 280/810 |

FOREIGN PATENT DOCUMENTS

| | | | |
|---|---|---|---|
| 13780 | 6/1903 | Austria | 280/810 |
| 786786 | 9/1935 | France | 280/87.04 A |

*Primary Examiner*—David M. Mitchell

*Attorney, Agent, or Firm*—Lewis H. Eslinger

[57] ABSTRACT

A tool for sailing with skates, skis, roller-skates, skateboard or corresponding gears. The invention consists of a carrier bar (1), fastening points (24,25) movable in the longitudinal direction of the carrier bar for connection at the sailor's feet or a corresponding point, centering means (16,18,22) for controlling the position of the fastening points along the carrier bar so that the center of the latter is always substantially half-way between the fastening points, and a holder (10) articulately mounted at the center of the carrier bar for fastening a sail carrying mast (13).

10 Claims, 3 Drawing Figures

TOOL FOR SAILING WITH SKATES ETC.

The present invention refers to a tool for sailing with skates, skis, roller-skates or corresponding gears. The tool is intended to be used together with a mast equipped with boom and sail (rig), preferably a to-day generally occuring wind-surfing sail.

Tools for skate and ski sailing are well-known. In the simplest case such a tool consists of a sail which is stretched over crossed tubes of metal or bamboo. The disadvantage of this way of sailing is that the sailor must carry the weight of the sail with his hands and back. This limits the sailor's possibility of sheeting the sail. In sailing with ice yachts the said is arranged on a skeleton which is provided with runners. The sail is sheetable. The disadvantage of this way of sailing is, however, that the sailor must invest large sums in skeleton and sail.

Recently, wind surfing has become a very popular sport. However, the wind-surfers cannot practice the sport in wintertime.

The present invention aims at providing a tool which permits not only skate sailing but also ski sailing, roller-skate sailing, skate board sailing etc. by using a conventional wind-surfing sail with mast and boom as used in the wind-surfing sport. As distinct from the skeleton of ice yachts as mentioned by way of introduction, the tool has to be cheap and easy to transport to and from the place of the sailing. Furthermore, the tool is to be used for carrying the wind-surfing sail at a place situated between the sailor's legs at the same time as the sailor has to be able to move his legs independently of each other and rather unhampered by the tool. The mast of the wind-surfing sail, thus being affixed to the tool, has to be capable of swinging unhindered to both sides and has also to be capable of tilting forward and backward. Also, the mast has to be rotatable about its longitudinal axis.

The characteristics of the invention are a carrier bar, fastening points movable in the longitudinal direction of the carrier bar for connection at the sailor's feet or a corresponding point, centering means for controlling the position of the fastening points along the carrier bar so that the centre of the carrier bar is always substantially half-way between the fastening points, and a holder articulately mounted at the centre of the carrier bar for fastening a sail-carrying mast.

The invention will be described more in detail with reference to the attached drawing in which.

Figure 1:
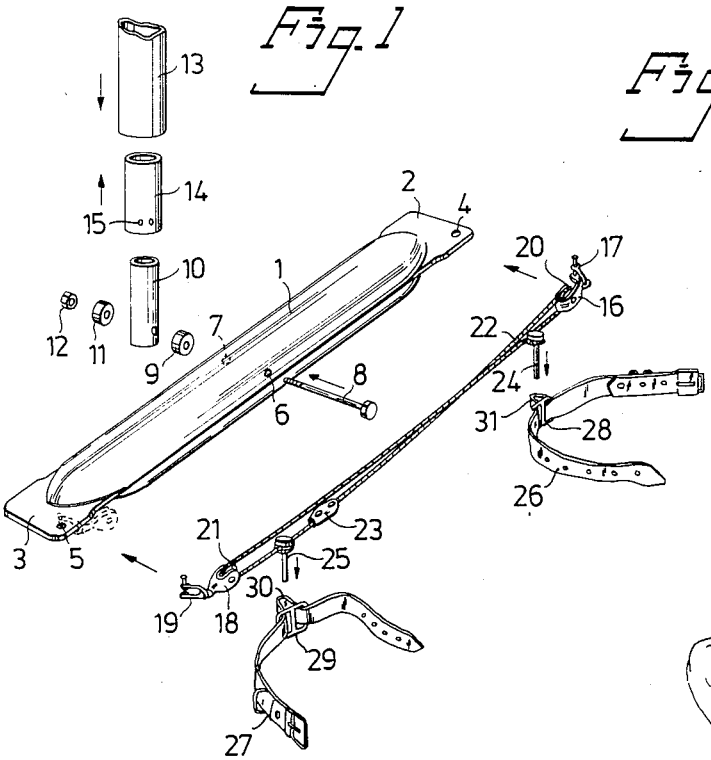
FIG. 1 is an exploded view of the tool according to the present invention.

In FIG. 1 a carrier bar 1 is shown in the form of a piece of tube having flattened end portions 2, 3. In either flattened end portion there is a through opening 4 and 5, respectively. In the middle of the carrier bar there are two aligned openings 6, 7 which are at right angles to the longitudinal axis of the carrier bar. A pivot pin in the form of a bolt 8 which is threaded only in the front end thereof is put through the openings 6 and 7. Thereupon, the pivot pin has threaded on to it in turn a bushing 9 of rubber or plastic, a sleeve 10, another bushing 11 of plastic or rubber, and a nut 12. At its bottom the sleeve 10 has two aligned openings through which the pivot pin is threaded. The bushings 9 and 11 each have a through opening through which the pivot pin extends. By means of the nut 12 the bushing 11 is then tightened against the sleeve 10 which in turn tightens the bushing 9 against the peripheral surface of the carrier bar. The nut is tightened only so firmly that the sleeve 10 may rotate about the pivot pin 8.

Before a conventional wind-surfing sail is used together with the tool according to the present invention the universal joint conventionally present at the mast foot of the wind-surfing sail must first be removed. The sail is stretched tight between the mast top and the mast foot by means of a sleeve 14 inserted in the foot 13 of the mast and provided with holes 15 into which means for stretching down the sail, for example lines, are introduced. The dimensions of the sleeve 14 are such that it may be inserted in the mast of the wind-surfing sail at the same time as the sleeve 14 has to be capable of being threaded on to the sleeve 10.

In case other sail structures than that described are used, then depending on the actual structure, the sleeve 14 may be omitted and the mast 13 be threaded either directly on to or directly into the sleeve 10.

A block 16 is fastened with a shackle 17 in the opening 4 while another block 18 is fastened with a shackle 19 in the opening 5. Between the two sheaves 20, 21 of the blocks 16 and 18, respectively, a line 22 is laid in a closed loop. If desired, the loop may be laid in a figure of eight. Both ends of the line are connected with each other by means of a line lock 23, for example so called line purse of a kind known in itself. A characteristic of the line purse is that the line need not be locked by means of any movable members but can be locked by clamping in a groove made in the body of the line purse. Before the line is stretched to its final position two fastening members 24 and 25 are anchored to one part each of the line and at equal distances from the respective block. Each fastening member may, for example, be in the form of a pin with a head at one end thereof. After the fastening members being anchored, for example by tieing of the pins, the line is stretched fairly hard and is fixed in the line lock 23.

The tool has associated with it two straps 26, 27 with conventional buckles and buckle holes. On each strap there is a fastening point which fits into one of the fastening members 24 or 25, respectively, on the line. In the embodiment described of the invention each fastening point is formed by a plate 28, 29 threaded on to the strap in question and provided with two longitudinal through slots. The strap is threaded through the slots in the way shown in the figure so that a loop 30 or 31, respectively, is formed. The size of the loop is adjusted so that it receives the pins 24, 25 with a close fit.

Normally, the sailor keeps the straps and the assembled tool separately. When going to sail he takes the tool, the straps and the surfing sail fastened to the mast along together with the skates or any of the other means of conveyance described. At the place of sailing he fastens the straps, one to each leg, down at the ankle so that the loops 30, 31 point forward, whereupon he moves the pins 24, 25 into the loops. The sailor may now move his legs fairly unimpededly, and he may definitely walk and also do skate edges. In principle, the length of steps is limited only by the length of the carrier bar.

Figure 2:
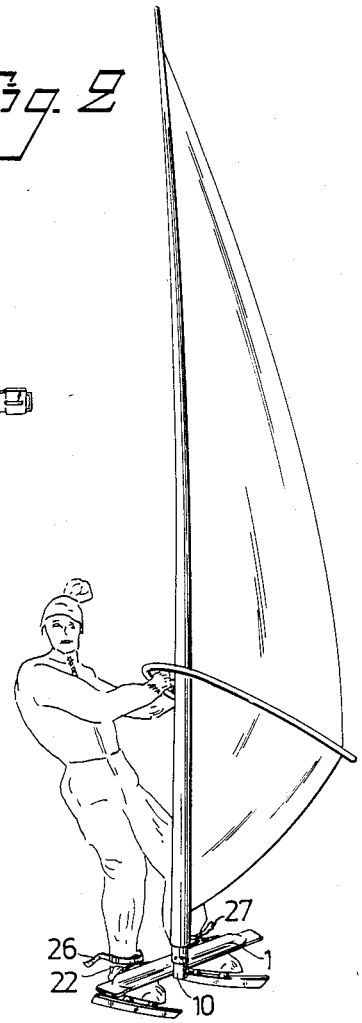
FIG. 2 shows the tool mounted for skate sailing.

The sail mounted on the mast is suitably put on the ground, and the sailor places himself with the wind behind him, turns the sleeve 10 towards the ground and threads the mast. Then the sail is lifted, and the sailor sheets home, whereupon the sail and sailor goes off aided by the wind as is shown in FIG. 2. The straps 26, 27 have preferably been tightened by the sailor so that the weight of the carrier bar loaded by the sail is partly received by the upper side of the sailor's footwear and partly by his ankles. In addition to the sail being capable of swiveling about the pivot pin 8 and turning around the mast in the sleeve 10, the sail may be turned about an axis which is parallel and/or coincides with the longitudinal axis of the carrier bar. In other words, the sail can also be tilted to a certain extent forward and backward.

The load by mast and sail is received by the sleeve 10 connected with the carrier bar. Thus, the sleeve forms a point of support which owing to the centering member formed by the line and the sheaves is always half-way between the sailor's legs independently of their mutual position. By the fact that the sailor is able to move his leg fairly without hindrance he may, for example, by shifting one leg, also shift the centre of the carrier bar, i.e. also the foot point of the mast. The point of support mentioned above may, accordingly, also be said to be a steering point for the mast. Owing to the said combined point of support and steering point always being half-way between the sailor's legs the sailor can steer the sail in a simple and advantageous way in relation to the wind, at the same time as he can easily keep his balance. It is seen that if the sailor stands still with one foot and takes a step of the length a with the other foot, the fastening point corresponding to the first foot remains still, while the other fastening point moves the length a along the carrier bar. The carrier bar takes up this movement by moving the length 0.5 a.

The arrangement with the pons threaded into the loops forms a safety device which releases and disengages the sailor from carrier bar and rig when the pins are subjected to a force from below, which occurs, for example, if the equipage goes down through the ice and/or when the sailor performs extreme or unnatural movements with his legs.

Figure 3:
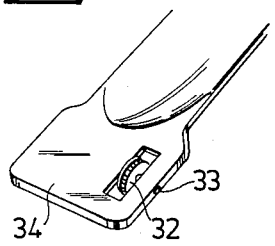
FIG. 3 is a detail view of an embodiment of a centering member included in the tool.

Instead of the arrangement with a block and shackle at either end of the carrier bar the arrangement shown in FIG. 3 may be used which includes a sheave 32 which is rotatably mounted on a diagrammatically shown axle 33 in a rectangular through opening 34. It is seen that a corresponding arrangement exists at the opposite end of the carrier bar and that the line runs over the sheaves in the way earlier described.

The embodiment of the invention described above may be modified and varied in many ways within the scope of the basic concept of the invention.

I claim:

1. A tool for sailing with any of skates, skis, roller-skates and corresponding gear, comprising a carrier bar, fastening means movable relative to said carrier bar for connection of said carrier bar proximate to the sailor's feet, centering means attaching said fastening means to said carrier bar for controlling the position of said fastening means relative to said carrier bar so that the center of said carrier bar remains substantially half-way between said fastening means regardless of the distance therebetween, and a holder articulately mounted at the center of said carrier bar for fastening a sail-carrying mast.

2. A tool according to claim 1, wherein said carrier bar is rotatable relative to said fastening means about an imaginary axis parallel with the axis between said fastening means.

3. A tool according to claim 1, wherein said holder includes a holding sleeve rotatably mounted on a pin which extends at right angles to the axis of said carrier bar between said fastening means.

4. A tool according to claim 3, further comprising a tightening sleeve for a sail, which tightening sleeve includes a stretching device for tightening members fixed to the sail for stretching down the sail, and which tightening sleeve has an outer diameter which permits putting said tightening sleeve into a bottom portion of the mast and an inner diameter which permits threading said tightening sleeve on to said holding sleeve.

5. A tool for sailing with any of skates, skis, roller-skates and corresponding gears, comprising a carrier bar, fastening means movable relative to said carrier bar for connection of said carrier bar proximate to the sailor's feet, centering means attaching said fastening means to said carrier bar for controlling the position of said fastening means relative to said carrier bar so that the center of said carrier bar remains substantially half-way between said fastening means, said centering means including sheaves rotatably mounted at both end portions of said carrier bar and a line stretching in an endless loop between said sheaves, and a holder articulately mounted at the center of said carrier bar for fastening a sail-carrying mast.

6. A tool according to claim 5, wherein each said sheave is part of a block fastened by a shackle in an opening in either end portion of said carrier bar.

7. A tool according to claim 5, wherein each said sheave is rotatably mounted in an opening in either end of said carrier bar.

8. A tool according to claim 6 or 7, wherein said fastening means each include a pin, one anchored on one part of said loop and the other on another part of said loop, both said pins being movable relative to said carrier bar and being anchored to the line on opposite sides of the center of said carrier bar and at equal distances therefrom.

9. A tool according to claim 8, wherein said carrier bar is formed by a piece of tube having flattened end portions.

10. A tool according to any one of claims 5 to 7, wherein said fastening means includes clamping straps each provided with a plate in which there are made two slots through which the respective strap is led in a loop for receiving a respective fastening pin attached to said loop, said clamping straps being adapted to be fastened to the sailor.

* * * * *